US006062880A

United States Patent [19]

Skuza

[11] Patent Number: 6,062,880

[45] **Date of Patent: *May 16, 2000**

[54] ELECTRICAL PLUG HAVING PIVOTABLE BLADE ASSEMBLY

[75] Inventor: Voyteck T. Skuza, Park Ridge, Ill.

[73] Assignee: International Components Corporation, Chicago, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/963,329

[22] Filed: Nov. 3, 1997

[51] Int. Cl.[7] ..... H01R 13/44

[52] U.S. Cl. ..... 439/131; 439/174

[58] Field of Search ..... 439/131, 171, 439/174

[56] References Cited

U.S. PATENT DOCUMENTS

| | | | |
|---|---|---|---|
| 1,386,884 | 8/1921 | McKay | 439/131 |
| 1,485,193 | 2/1924 | McKay | 439/131 |
| 2,538,296 | 1/1951 | Crocker | 439/172 |
| 2,594,850 | 4/1952 | Benander | 439/694 |
| 4,467,263 | 8/1984 | Conforti et al. | 439/131 |
| 4,641,908 | 2/1987 | Steffinger | 439/599 |
| 4,997,381 | 3/1991 | Oh | 439/172 |
| 5,213,516 | 5/1993 | Okamoto | 439/104 |
| 5,401,178 | 3/1995 | Liu | 439/131 |
| 5,494,449 | 2/1996 | Chioo | 439/761 |
| 5,613,863 | 3/1997 | Klaus et al. | 439/131 |
| 5,628,641 | 5/1997 | Hahn | 439/131 |
| 5,713,749 | 2/1998 | Wu | 439/131 |

FOREIGN PATENT DOCUMENTS 296 16 815 1/1997 Germany .

*Primary Examiner*—Kheim Nguyen
*Assistant Examiner*—T C Patel
*Attorney, Agent, or Firm*—Fitch, Even, Tabin & Flannery

[57] ABSTRACT

A pivotable electrical plug assembly includes a pair of elongated blades, such as rod shaped European style blades. A detent mechanism is formed with electrically conductive resilient members for releasably retaining rear portions of the elongated blades, for example, European rod shaped blades. The plug assembly is pivotally mounted to an appliance housing, such as a consumer electronic appliance or device, with the resilient members being mounted in fixed position relative to the appliance housing. The resilient members are adapted to extend into the appliance housing to engage the blades without requiring any modifications to the standard blade design.

9 Claims, 4 Drawing Sheets

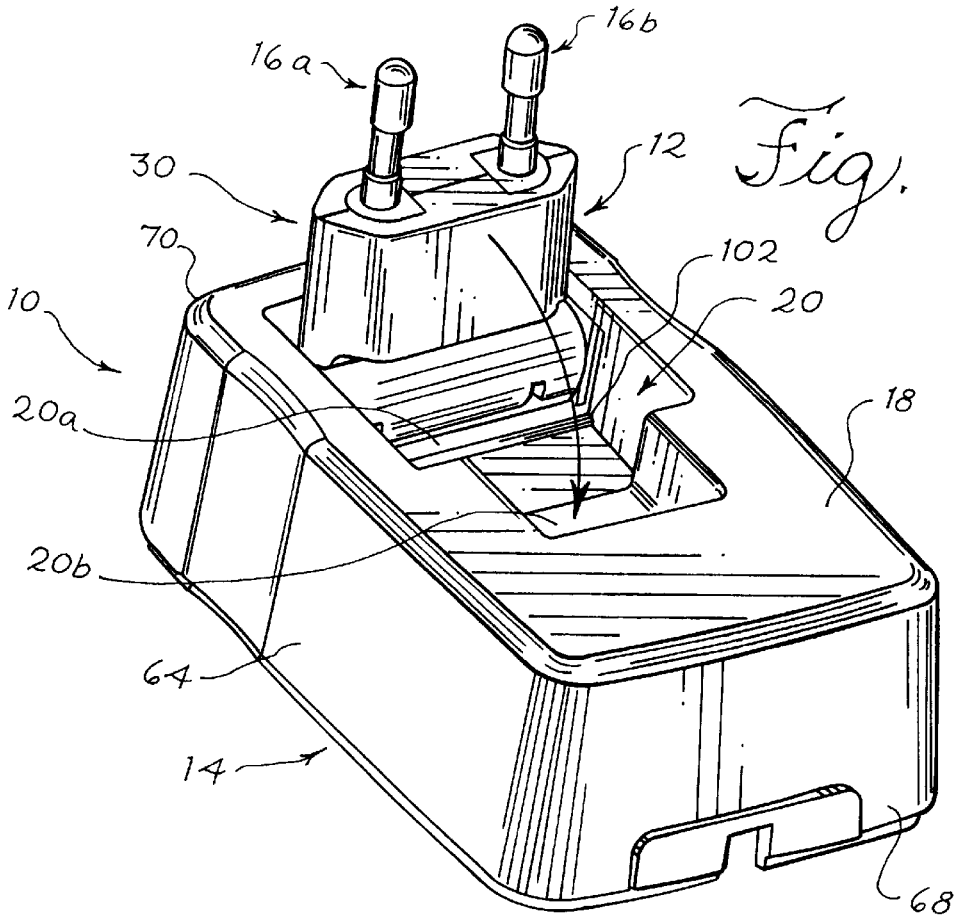
Fig. 1
Fig. 2
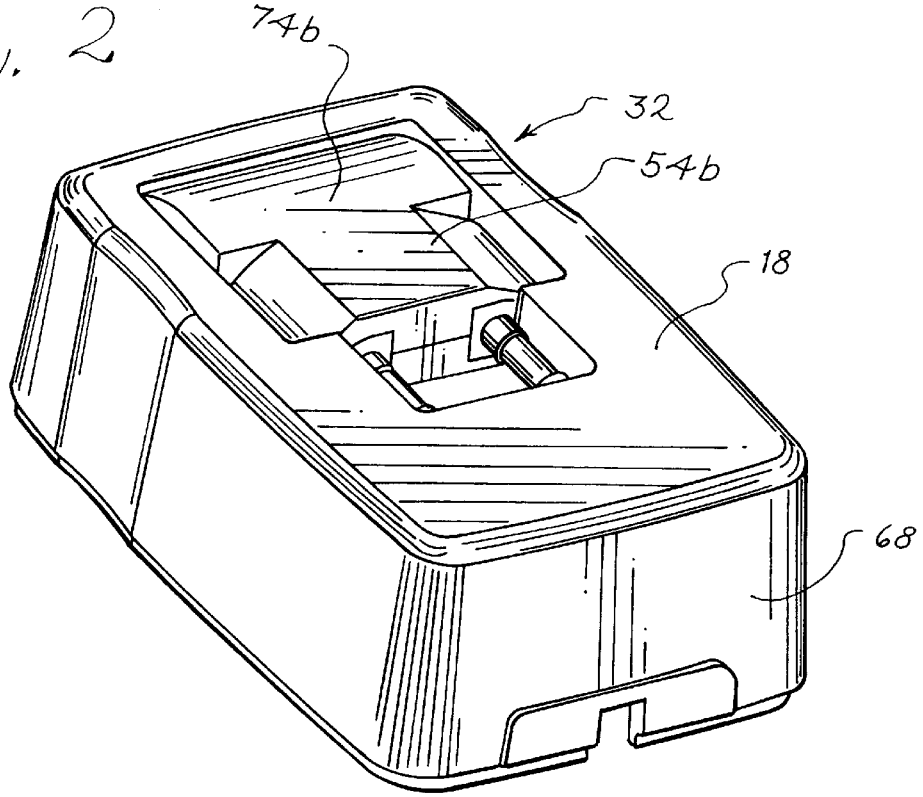

ELECTRICAL PLUG HAVING PIVOTABLE BLADE ASSEMBLY

FIELD OF THE INVENTION

The present invention relates to electrical plug assemblies, and more particularly, to an electrical plug assembly with pivotal blades.

BACKGROUND OF THE INVENTION

The relatively recent boom of the electronics industry, particularly in the consumer electronic market has yielded a number of portable appliances with rechargeable batteries, such as cellular phones and flashlights, which utilize electrical plug assemblies with pivotable blades used for battery charging. The pivotable blades are pivotable to a use position to enable the blades to be plugged into a mating electrical socket, such as a conventional wall outlet, for battery charging and a retracted or storage position.

Prior pivotable plug assemblies utilized in electronic devices have generally required modifications to the standard blades to provide a detent function for releasably holding the blades in either a use position or retracted storage position relative to the appliance housing. Examples of plug assemblies having modified blades are shown in U.S. Pat. No. 4,467,263 to Conforti et al.; U.S. Pat. No. 5,401,178 to Liu; and U.S. Pat. No. 5,494,449 to Chioo.

European electrical plug assemblies include blades formed as a rod with a generally circular cross sectional shape to conform to the mating electrical sockets employed in Europe. Since such blades do not provide the flat curved end like standard flat blades utilized in the United States, any modifications to accommodate a detenting function, for example, as discussed in the aforesaid patents, is made more difficult due to their smaller rounded ends. Accordingly, a pivotable plug assembly which does not require modifications to the blades, and in particular to European style rod-shaped blades, would be desirable.

Another major problem with pivotable plug assemblies is the large number of parts, such as springs and ball bearings, utilized for both the electrical and detent functions. The large number of parts increases the complexity and expense associated with manufacturing pivotable plug assemblies which translates into higher costs for the consumer appliance with which they are utilized. Since appliances with pivotable blades are typically very price sensitive products, any unnecessary costs associated with parts or manufacturing are to be avoided. Accordingly, there is a need for a plug assembly with pivotable blades which utilizes a low cost, easy to assemble detent mechanism for the plug assembly and which does not require modifications to standard existing blade designs.

SUMMARY OF THE INVENTION

In accordance with the present invention, a pivotable plug assembly is provided with a pair of elongated blades, for example, European rod shaped blades. A detent mechanism is formed with electrically conductive resilient members for releasably retaining rear portions of the elongated blades. The pivotable plug assembly is pivotally mounted to an appliance housing, such as a consumer electronic appliance or device, with the resilient members being mounted in fixed position relative to the appliance housing. The resilient members are adapted to extend into the appliance housing to engage the blades without requiring any modifications to the blade design.

BRIEF DESCRIPTION OF THE DRAWINGS

FIG. 1 is a perspective view of an electrical plug assembly in an exemplary appliance housing in accordance with the present invention showing the blades in an active position;

FIG. 2 is a perspective view similar to FIG. 1 showing the blades in a storage position;

DETAILED DESCRIPTION OF THE DRAWINGS

Figure 3:
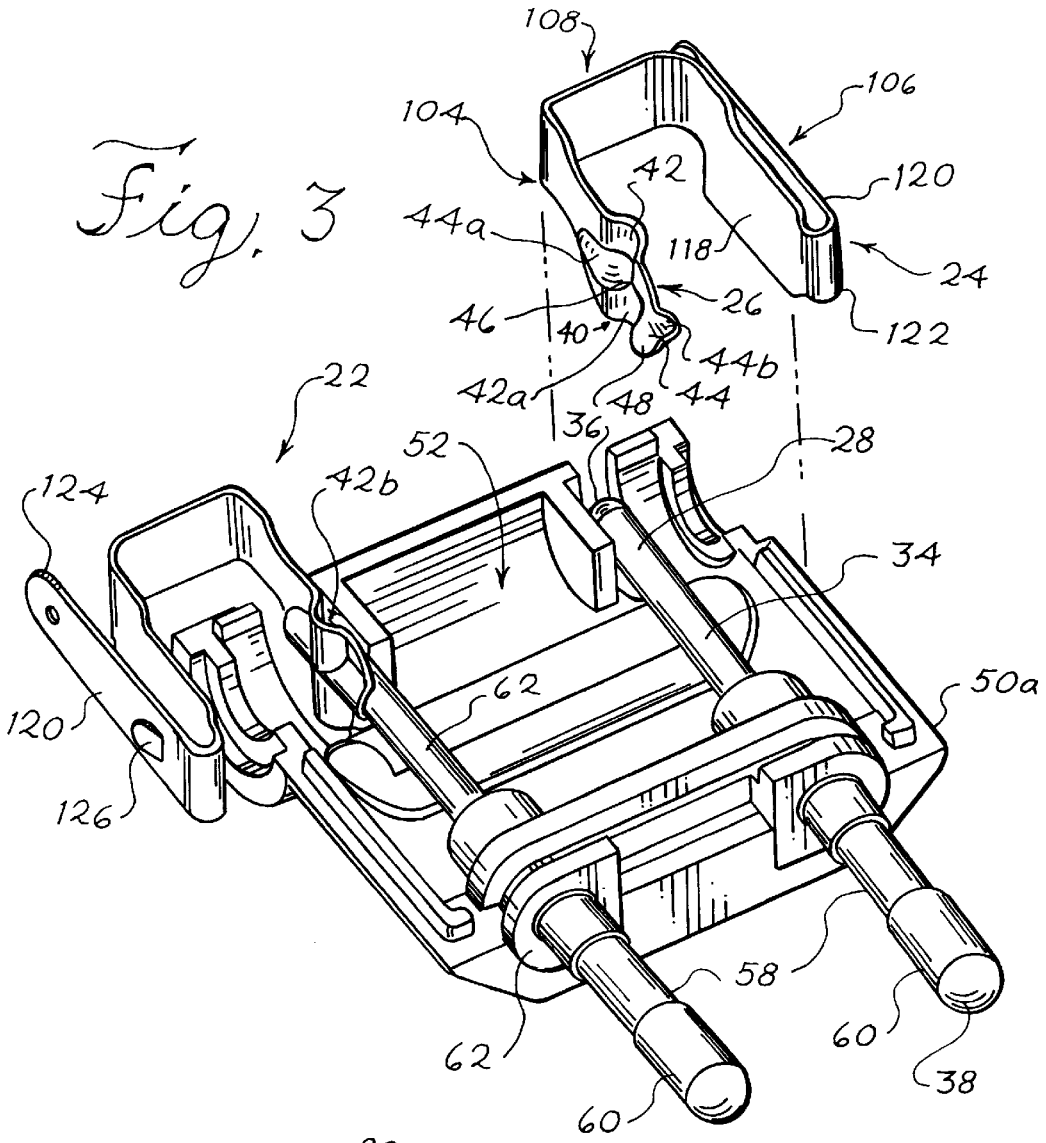
FIG. 3 is a perspective view of the electrical plug assembly illustrated in FIG. 1, shown without the appliance housing and partially disassembled with a portion of housing removed.

FIG. 1 illustrates an electrical plug assembly 10 shown disposed in an exemplary appliance housing 14 having a pivotable plug assembly 12 in accordance with the present invention. It will be recognized that the appliance housing 14 can take on a wide variety of forms without departing from the invention herein. For instance, the appliance housing 14 can be a consumer electronic device, e.g. cellular phones, flashlights, electric razors, etc, or a rechargeable battery pack for the same. The appliance housing 14 is adapted to carry the electrical device or circuitry, such as a recharging circuit in its interior with the plug assembly 12 electrically connected thereto for powering of the same.

The preferred plug assembly 12 includes a pair of blades 16*a* and 16*b* which have a generally rod-shape having a cylindrical outer surface with rounded ends adapted for use in standard European socket outlets. Other blade styles besides the illustrated and described rod-shaped blades 16 can be utilized and still fall within the purview of the present invention. The appliance housing portion 14 can include a face wall 18 having a recessed well 20 formed therein to accommodate pivoting of the plug assembly 12 from the raised, pivoted up ("use position") position shown in FIG. 1, to the lowered position with the plug assembly 12 pivoted down in the well 20 ("storage position"), as shown in FIG. 2.

The electrical plug assembly 12 includes a detent mechanism, generally designated 22 (FIG. 3), which allows the plug assembly 12 to pivot from the first predetermined raised or USE position (FIG. 1) to the second predetermined down or STORAGE position (FIG. 2). The detent mechanism 22 may be formed from resilient members 24 in the form of electrically conductive spring members each having a blade engaging portion 26 which resiliently engage the rear portions 28 of the blades 16 to releasably retain the blades 16 for pivoting of the electrical plug assembly 12 between the USE and STORAGE positions, 30 and 32, respectively. The use of the spring members 24 result in a reduced number of parts for the detent mechanism 22 with detent mechanisms in comparison to prior electrical plug assemblies thus lowering manufacturing costs and reducing the complexity of the electrical plug assembly 10.

Referring to FIG. 3, the detent mechanism 22 is shown for use with European-style blades 16. As previously mentioned, the European-style blades 16 have a generally rod-shape with a cylindrical outer surface 34 which can include sections that have different diameters. The rod-shaped blades 16 include a rear rounded end 36 and front rounded end 38. Blade engaging portions 26 of the spring members 24 can be provided with transverse concave recesses 40 in which the blade rear portions 28 are releasably retained. The concave surfaces of the recesses 40 substantially conform to the exterior cylindrical surfaces of the rod-shaped blades 16. In the illustrated form, the concave recesses 40 include a lateral recess 42 which intersects with a longitudinal recess 44 to form a common recessed area 46 in the blade engaging portions 26 of the spring members 24. When the electrical plug assembly 12 is assembled and pivotally mounted to the appliance housing 14 with the spring members 24 fixed relative thereto as will be more fully described herein, the blade rear portions 28 will be resiliently engaged by the blade engaging portions 26 with the recesses 42 and 44 defining first and second seats for the blade rear portions 28. The recesses 44 and 46 intersect at substantially right angles to each other so that the blades 16 are pivoted roughly ninety degrees between the USE and STORAGE positions, 30 and 32.

When the blades 16 are in the USE position 30 as shown in FIGS. 1 and 3, the blade rear portions 28 are seated in longitudinal recesses 44 with the blade rear curved end 36 disposed in the forward open-ended portion 44*b* of the recess 44 and the blades 16 projecting out therefrom. In the STORAGE position as shown in FIG. 2, the blade rear portions 28 will be seated in lateral recesses 42 with the blade rear curved end 36 disposed in upper portion 42*b* of the recesses 42 and the blades 16 projecting out from the lower open ended portions 42*a* thereof. The spring members 24 allow pivoting between the first and second predetermined positions 30 and 32 when a pivoting force is exerted on the plug assembly 12. The pivoting force causes the rounded ends 36 and cylindrical surfaces 34 of the blades 16 to cam against the curved surfaces of the one of the concave recesses 42 and 44 in which the blade rear portions 28 are releasably retained. The blade rear portions 28 will then move out from the particular recesses in which they are seated and cam over the raised shelf walls 48 between the recesses with the resilient spring members 24 deflecting to accommodate such camming action until the blade rear portions reach the other recesses 42 or 44 to which they are pivoted towards. Once the blade rear portions 28 are pivoted sufficiently, the blade engaging portion 26 will rebound so as to releasably retain the blade rear portions 28 in the recesses 42 or 44. As is evident from the above, the resilient spring members 24 including the blade engaging portions 26 thereof are a substantial improvement over prior detenting mechanisms for blade assemblies in that a single spring member 24 is associated with each blade 16 significantly simplifying assembly and reducing costs for the electrical plug assembly 10 herein.

The electrical plug assembly 12 includes a plug housing 50 (FIGS. 3 and 4) having a substantially hollow interior 52 with the blade 16 being rigidly mounted therein. Typically, such housings for electrical plug assemblies are of solid construction; however, the hollow housing 52 herein allows the blade engaging portions 26 of the spring members 24 to extend into a housing interior 52 for engaging with the rear portions 28 of the blades 16, as best seen in FIG. 3. To provide for access into the interior 52 of the housing 50, a housing rear portion 54 is provided with a pair of spaced access slots 56 therein. When the spring members 24 are fixed relative to the appliance housing 14, the blade engaging portions 26 of the spring members 24 will extended through the access slots 56 into engagement with the blade rear portions 28.

Figure 4:
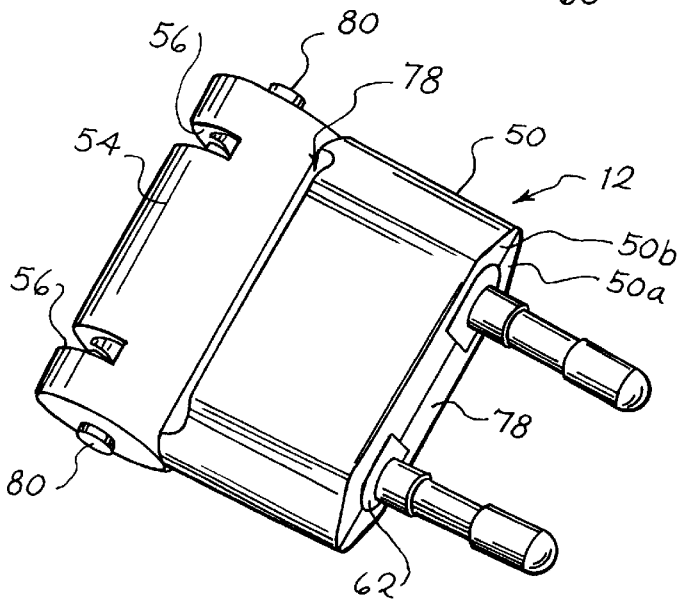
FIG. 4 is a perspective view of the electrical plug assembly illustrated in FIG. 3 with the appliance housing removed.
Figure 9:
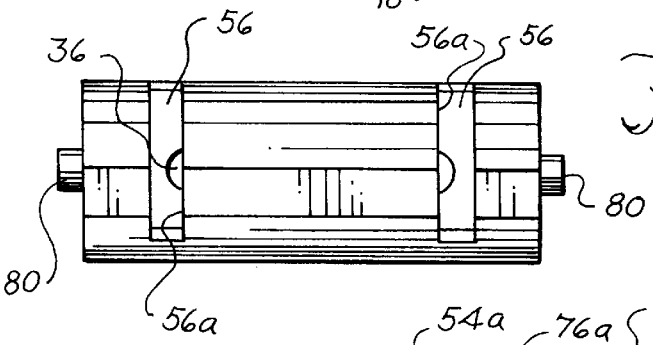
FIG. 9 is an end elevation view of the electrical plug assembly.

The electrical plug housing 50 may be formed in a clam shell design with one half of the housing 50*a* illustrated in FIG. 3 and the other half 50*b* removed for viewing of its interior 52. The blades 16 extend from their rear portions 28 through the interior 52 of the housing 50 and to the exterior thereof with the exterior portion 58 having a plastic coating therearound to minimize the amount of metal material exposed outside the plug assembly 50. The blades 16 include conducting metal tips 60 connected to the conductor portion 62 of the blades 16 surrounded by the plastic. The blades 16 have intermediate collars 62 attached on the plastic portions 58 thereof for being clamped in correspondingly shaped openings of the clam shell housing halves 50*a* and 50*b* to rigidly mount the blades 16 to the assembled plug housing 50, as shown in FIG. 4. With the blades 16 mounted to the housing 50, the blade rear portions 28 are disposed relative to the access slots 56 so that primarily only the outer half of the blade rear portions 28 extend beyond the inner wall 56*a* of the housing slots 56, as can be seen in FIG. 9. Thus, when the blade engaging portions 26 are inserted through the slots 56 with the blade rear portions 28 received in one of the recesses 40, the rear portions 28 of the blades 16 will be substantially hidden from view by the curved walls of the recesses 40 as the half of the blade rear portions 28 which extend beyond the slot inner walls 56*a* will be seated in one of the concave recesses 40.

The appliance housing 14 can be provided with side walls 64 (FIGS. 1 and 2) and 66 (FIG. 7) and opposite end walls 68 and 70 (FIG. 1) which are connected between the side walls 64 and 66 with the side walls 64 and 66 and end walls 68 and 70 extending substantially perpendicularly from the periphery of the face wall 18 of the appliance body portion 14*a*. As previously mentioned, the appliance housing 14 can take on other forms from that described herein without departing from the present invention. The face wall 18, sidewalls 64 and 66 and end walls 68 and 70 taken together define a appliance housing interior 72 in which electrical components or circuitry can be mounted for being electrically connected to the conductive spring members 24, as will be more fully described hereinafter.

Figure 8:
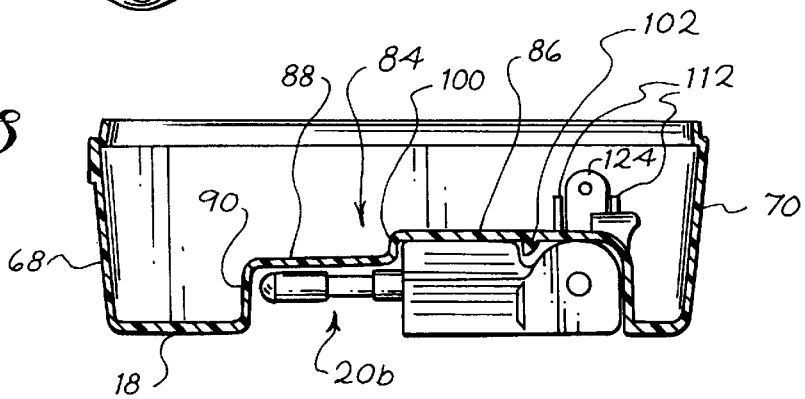
FIG. 8 is an elevation view partially in section showing the electrical plug assembly and appliance housing with the blades in a storage position.
Figure 10:
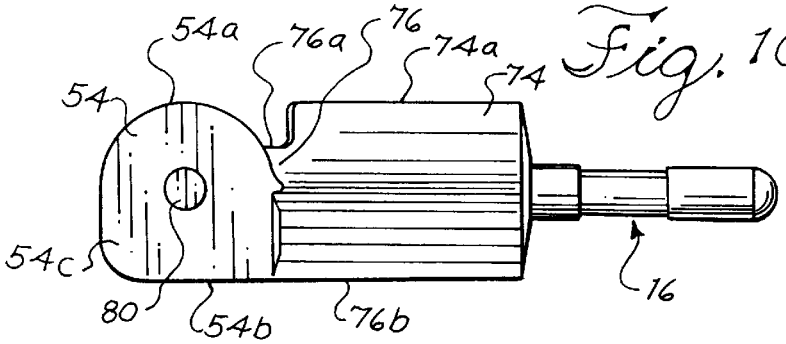
FIG. 10 is an end elevation view of the electrical plug assembly.

Referring to FIGS. 8–10, the electrical plug housing 50 can be generally divided into a rear portion 54, a front portion 74 and a transition region 76. The front portion 74 includes a front wall 78 in which the openings for the blade collars 62 are formed so that the blades project forwardly from the front wall 78 exteriorly of the plug housing 50. The rear and front portions 54 and 74 may be of different configurations as shown. In particular, the rear portion 54 can have a generally bread box type shape in cross section taken along a plane parallel to the blades 16 and substantially perpendicular to the front wall 78 while the front portion 74 has a substantially hexagonal cross-sectional shape taken along a plane perpendicular to the blades 16 and parallel to the front wall 78. In addition, the intermediate region 76 has a lowered top wall 76*a* relative to top wall 74*a* of the front portion 74 and also lower than the curved peak 54*a* of the rear portion 54 so as to form an elongate indentation 78 in the appliance housing 12 which extends across the appliance housing 12 in between the rear and front portions thereof, 54 and 74. The access slots 56 extend substantially 45° around the rear curved section of rear portion 54 ending at approximately the peak 54*a* thereof, and at the bottom around the lower rear corner 54*c* of the housing rear portion 54 to allow the housing 50 to be pivoted 90° between the USE and STORAGE positions 30 and 32 while the springs 24 remain fixed.

Figure 5:
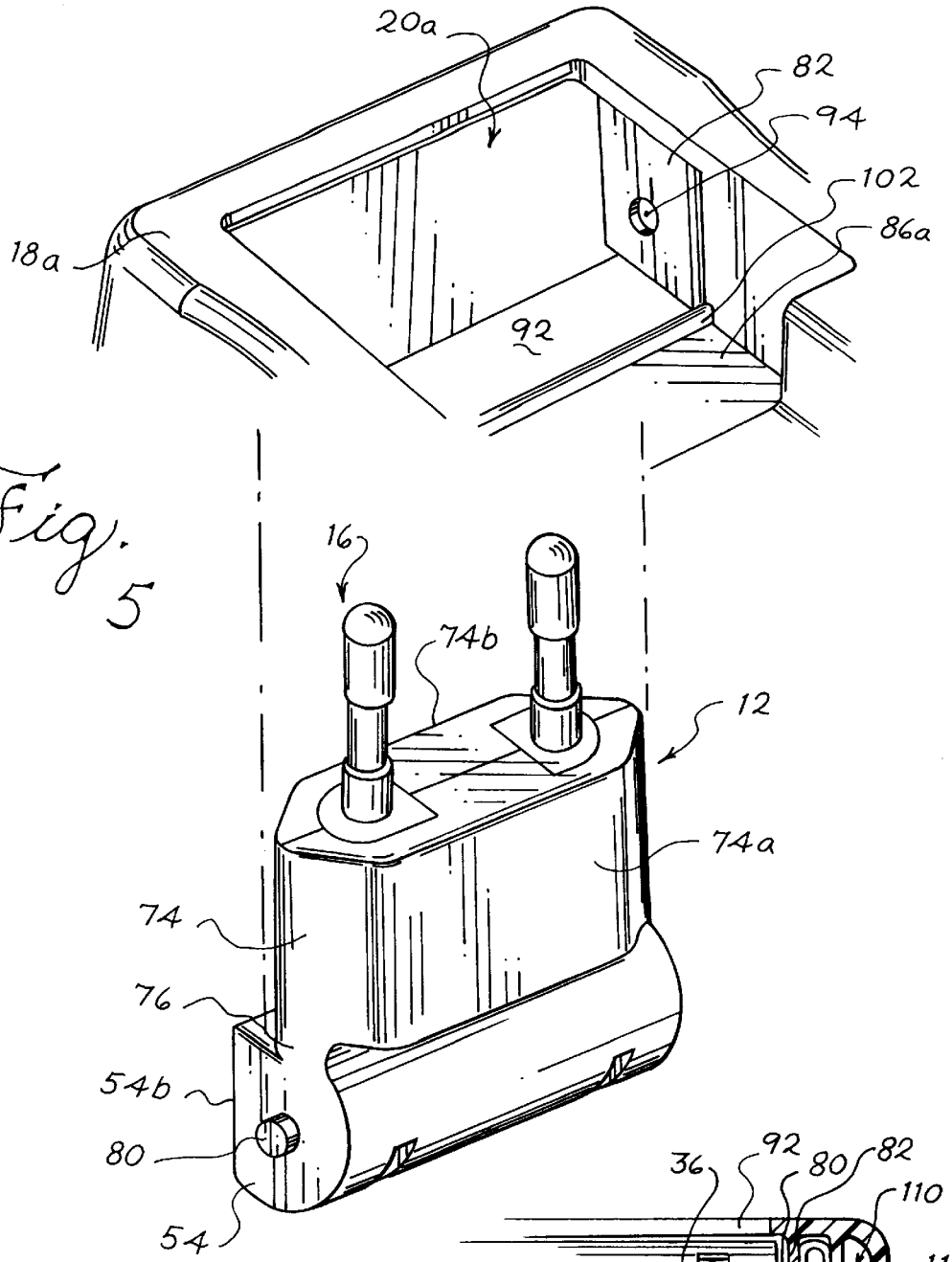
FIG. 5 is an exploded perspective view of the electrical plug assembly shown removed from the appliance housing.

The electrical plug housing 12 is pivotally mounted to the appliance housing 14 via trunnions 80 that are formed on either side of the rear portion 54 and cooperating mounting members 82 in the form of resilient projections integrally formed with the appliance housing 14. More specifically, the well 20 of the appliance housing 14*a* has a stepped bottom wall 84 recessed from the face wall 18, as best seen in FIG. 8. The stepped bottom wall 84 includes a lowermost wall portion 86 and a stepped wall portion 88 slightly raised relative to the wall portion 86. The stepped wall portion 88 is connected to the face wall 18 by vertical wall portion 90, whereas lower wall portion 86 terminates distal from vertical wall 90 so as to form through opening 92 through which the interior 72 of the appliance housing 14 can be accessed. A perimeter portion 18*a* of the appliance housing face wall 18 extends around the well 20 and through an opening 92 with the projections 82 extending from the perimeter portion 18*a* on either side of the through the opening 92 and projecting towards the appliance housing interior 72 to a point approximately aligned with the lower wall portion 86 of the appliance housing stepped bottom wall 84, as best seen in FIG. 5. The projections 82 each have an aperture 94 for receiving the trunnion bosses 80 therein.

Figure 6:
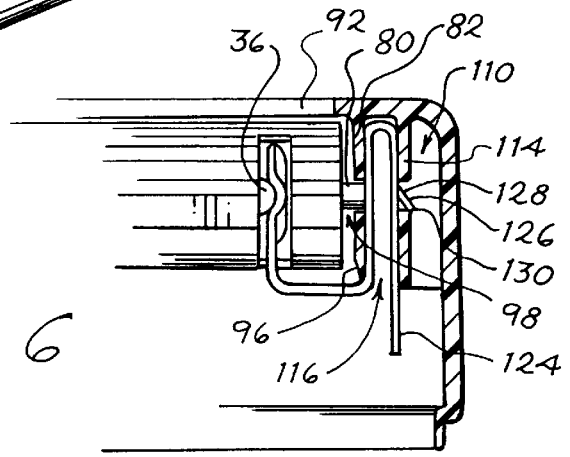
FIG. 6 is an elevation view partially in section illustrating the snap fit connection between the housing and the appliance housing.

The resilient mounting projections 82 may be provided with ramp surfaces 96 on their inner sides adjacent the appliance housing through opening 92 so that the ramp surfaces 96 of each of the projections 82 face each other across the through opening 92. The ramp surfaces 96 slope inwardly so that the projections 82 are thickest in width adjacent the face wall perimeter portion 18*a* and are thinnest adjacent the appliance housing lower wall portion 86. To pivotally mount the electrical plug assembly 12 to the appliance housing 14, the plug assembly 12 is oriented substantially as shown in FIG. 5 so that when moved in the direction from the interior 72 on the appliance housing 14 towards the exterior thereof, the blades 16 will first move through the through opening 92 followed by the front portion 74 whereupon the projecting trunnion 80 will engage the thin portion of the resilient projections 82, and specifically the inner facing ramp surfaces 96 thereof so as to resiliently deflect the projection members 82 outwardly away from each other. Continued sliding of the electrical plug housing 50, and specifically the trunnions 80 on the rear portion 54 thereof along the projection ramp surfaces 96 cams and deflects the projections 82 until the trunnions 80 are brought into alignment with the apertures 94 whereupon the projections 82 will rebound or snap back so as to capture the trunnions 80 in the projection apertures 94, as best seen in FIG. 6. In this manner, the electrical plug assembly 12 is provided with a press or snap fit to the appliance housing 14 with the electrical plug assembly 12 having a hinge for pivoting via the trunnions 80 and projection apertures 94. The snap fit assembly of the electrical plug assembly 12 to pivotally mount it to the appliance housing 14 substantially simplifies the assembly process and accordingly lowers costs associated therewith. With the electrical plug assembly 12 pivotally mounted to the appliance housing 14, the rear portion 54 will be disposed in the through opening 92 with the slots 56 thereof exposed in the appliance housing interior 72.

It will be recognized that the sizing of the components of the plug assembly 12 relative to the appliance housing 14 can be altered without departing from the scope of the present invention. The length of the electrical plug housing 50 from the rear end of the rear portion 54 to the front wall 78 of the front portion 74 is substantially equal to the distance from the rear of through opening 92 to riser wall portion 100 formed between the step walls 86 and 88. In addition, the height of the riser wall 100 is slightly less then the distance from the bottom wall 74*a* to the bottom of the blades 16. The length of the blades 16 exposed exteriorly of the housing 50 from the front wall 78 to the blade ends 38 is approximately the same or slightly less then the length of the step wall 88. The distance between the bottoms 54*a* and 74*a* of the housing rear and front portions 54 and 74, respectfully, to the top surfaces 54*b* and 74*b* thereof is substantially the same as the distance from the appliance housing lower wall portion 86 to the appliance housing face wall 18. Accordingly, when the electrical plug 12 is pivoted to its STORAGE position 32 as shown in FIG. 2, the housing 50 will be in well region 20a of the appliance housing well 20 over the well lowermost wall 86. In this position, the bottoms 54*a* and 74*a* of the housing 50 will be substantially level with the appliance housing lower wall portion 86 with the housing front portion bottom surface 74*a* abutting the exterior surface 86*a* of the lower wall portion 86. The exterior portions of the blades 16 will extend in the well region 20*b* over the step wall portion 88 but recessed from the appliance housing face wall 18, as best seen in the FIG. 8. The housing bottom surfaces 54*b* and 74*b* are substantially flat so that when the housing is pivoted down into the appliance housing well 20 in the down position 32, the housing surfaces 54*b* and 74*b* are substantially flush with the face wall 18.

Another feature of the present electrical plug assembly 10 is that the appliance housing 14 includes a lateral fence 102 disposed along the appliance housing through opening 92 so as to limit access from exterior of the appliance housing 14 to the interior 72 thereof, particularly when the electrical plug assembly 12 is in its pivoted up use position 30, as shown in FIG. 1, for safety purposes. The fence 102 extends along the edge of the appliance housing lower wall portion 86 adjacent the through opening 92 and projects a short distance towards the face wall 18 of the appliance housing 14. The configuration of the electrical plug housing 50 is such that when the electrical plug assembly 12 is pivoted to its down position 32, the fence 102 will project into the indentation 78 between the housing rear and front portions 54 and 74. In this manner, the indentation 78 provides clearance for the fence 102 during pivoting of the plug housing 50 down into the well 20.

As previously mentioned, resilient spring members 24 releasably retain the plug assembly 12 in the first and second predetermined positions, 30 and 32. The spring members 24 preferably have a generally U-shaped construction with side leg portions 104 and 106 and a substantially flat interconnecting base portion 108. The inner side portions 104 of the spring members 24 include the enlarged blade engaging portions 26 at their ends spaced from the base 108.

Figure 7:
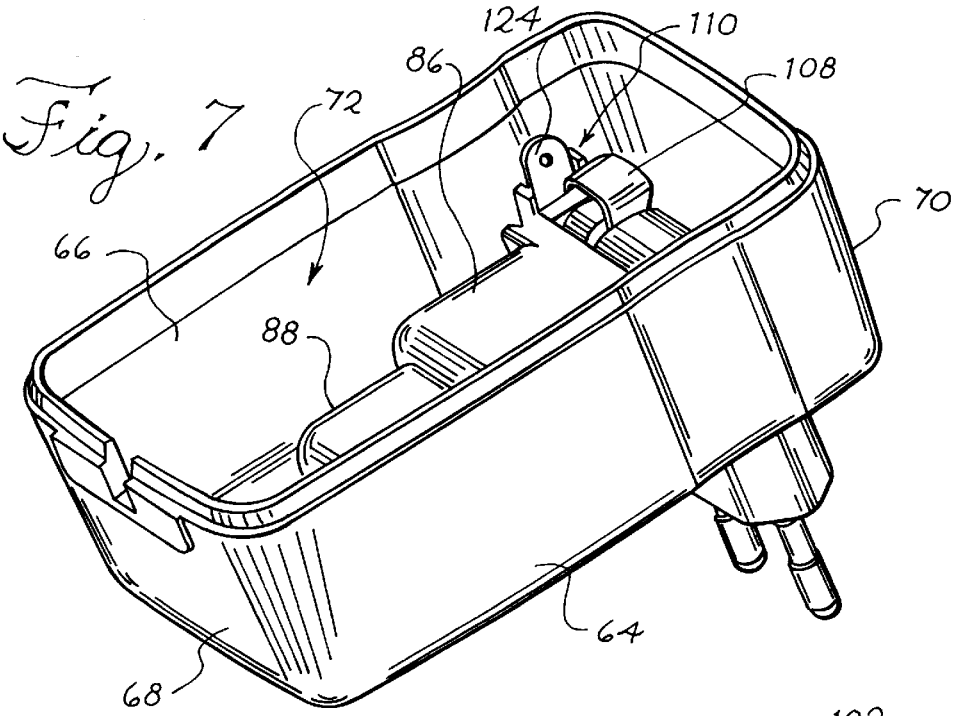
FIG. 7 is a view similar to FIG. 1 except with the appliance housing turned over to show the contact end portion and base portion of the spring disposed in the appliance housing interior.

For mounting the springs 24 in fixed position relative to the appliance housing 14, the appliance housing 14 includes spring mounting ribs 110 formed integrally therewith in the appliance housing exterior 72 on either side of the appliance housing through opening 92, as can be seen in FIGS. 6–8. The ribs preferably have an H-shaped cross-sectional configuration including cross members 112 which extend substantially perpendicular to the appliance housing walls 64 and 66 and a web member 114 interconnecting the cross members 112 at approximately their midpoints with the web members 114 being substantially parallel to the appliance housing walls 64 and 66. The ribs 110 are integrally formed with the appliance housing 114 such that each rib 110 is adjacent a appliance housing projection 82 with respective projections 82 being between corresponding adjacent ribs 110 and the appliance housing through opening 92. Thus, the ribs 110 and the outer sides of the projections 82 cooperate to define a spring receiving area 116 therebetween into which spring outer leg portion 106 can be inserted for assembly of the electrical plug assembly 10. In this manner, the springs 24 are attached to the appliance housing 14 spaced from the hinge 98 formed between the plug assembly 12 and appliance housing 14 by the trunnions 80 and projection apertures 94.

The outer side portion 106 of the spring members 24 may include two substantially parallel segments 118 and 120 interconnected by flexible arcuate hinge segment 122 spaced from the spring base 108 similar to the blade engaging portion 26. As shown, the outer parallel segment 120 extends from the hinge segment 122 back toward the base 108 to a contact end portion 124 of the spring members 24 so that when the spring members 24 are mounted in fixed position relative to the appliance housing 14, the contact end portions 124 of the springs 24 project into the appliance housing interior 72 for being electrically connected to the electrical components or circuitry therein. Each of the segments 120 also includes an offset tab projection 126 struck from the flat segment 120 so that it extends slightly out from the plane thereof. Rib web members 114 include apertures 128 substantially aligned with the mounting member apertures 94, and the apertures 128 include restraining surfaces 130 for engaging with the offset tab projections 126 to keep the assembled spring members 24 from being pulled toward the appliance housing interior 72 after assembly thereof.

To assemble the spring members 24, the electrical plug assembly 12 is preferably pivoted to its USE position 30 or second STORAGE position 32. The leg portions 104 and 106 of the spring members 24 are then aligned with the housing slots 56 and the spring receiving areas 116, respectively. The spring members 24 are then moved so that the blade engaging portions 26 are inserted through the slots 56 to be disposed in the housing interior 52 in engagement with the blade rear portions 28, and the spring side leg portions 106 are inserted into the receiving areas 116 between the outer surface of the mounting members 82 and the ribs 110. As the spring leg portion 106 is inserted into area 116, the segment 118 will bear against the mounting member 82 and the tab projection 126 of the segment 120 will bear against the web 114 so as to cause the segment 120 to resiliently deflect towards the segment 118. Continued insertion of the leg portions 106 into the areas 116 causes the tab projections 106 to pass the restraining surfaces 130 so that the segments 120 rebound towards their original configuration with the projections 126 engaged with the restraining surfaces 130 thereby maintaining the spring members 24 affixed to the appliance housing 14 against being pulled towards the appliance housing interior 52 with the blade engaging portions 26 in the housing interior 52 engaged with the blades rear portions 28. As is evident from above, similar to the plug assembly 12, the assembly of the spring detents 24 is provided by a press or snap fit substantially simplifying the assembly of the electrical plug assembly 10 herein.

As will be evident to those skilled in the art, it will be seen that the present electrical plug assembly 10 is a significant improvement over prior pivotable plug assemblies 12. The present pivotable plug assembly 12 utilizes spring detents 24 which do not require that the standard rod-shaped European blades 16 utilized therewith in one form of the invention be modified from their standard design thus lowering costs over those prior pivotable plug assemblies which require customized machining of the blades to accommodate the detenting function thereof. In addition, the spring members 24 may be formed from a one piece unitary design so as to reduce the number of parts for the detent mechanism 22 herein over prior detent assemblies utilized with pivotable plug assemblies. The electrical plug housing 12 and the spring detents 24 may be assembled by snap fit connections which simplifies the assembly of the present electrical plug assembly 10. Thus, the electrical plug assembly 10 has a very few number of parts that need be assembled with those parts being assembled in a very easy manner so as to reduce assembly time and improve production efficiency of the electrical plug assembly 10 lowering production costs thereof.

Obviously, many modifications and variations of the present invention are possible in light of the above teachings. Thus, it is to be understood that, within the scope of the appended claims, the invention may be practiced otherwise than as specifically described above.

What is claimed is:

1. In an electrical plug assembly including a pair of elongated blades having rear and forward portions with the forward portions being for insertion into a cooperating receptacle, a detent mechanism for pivoting of the blades between predetermined positions, the detent mechanism comprising:

at least one electrically conductive resilient member for engaging the rear portion of one of the blades and releasably retaining the blades in different pivoted positions;

a first seat of the resilient member having an open ended portion to allow the rear portion of the blade to be received in the first seat with the blade projecting through the open ended portion of the first seat and extending in a first direction; and a second seat of the resilient member having an open ended portion to allow the rear portion of the blade to be received in the second seat with the blade projecting through the open ended portion of the second seat and extending in a second direction transverse to the first direction to provide the blades with a first predetermined position and a second predetermined position when the one blade is received in the first and second seats, respectively, with the resilient member allowing the blades to be pivoted between the first and second predetermined positions;

wherein the first and second seats include a first seat recess and a second seat recess, respectively, with the first seat recess and the second seat recess intersecting and extending transverse to each other.

2. The detent mechanism of claim 1, wherein the first and second seat recesses intersect at substantially right angles so that the blades are pivoted substantially ninety degrees between their first and second predetermined positions.

3. The detent mechanism of claim 1, wherein the blades have substantially cylindrical surfaces, and the recesses are concave in shape to substantially conform to the cylindrical exterior configuration of the blade rear portion.

4. The detent mechanism of claim 1, wherein the at least one resilient member includes a pair of identical resilient members for engaging with rear portions of both blades and which each have contact ends remote from the blade seats for being electrically connected to other electrical contacts or circuitry.

5. In an electrical plug assembly including a pair of elongated blades having rear and forward portions with the forward portions being for insertion into a cooperating receptacle, a detent mechanism for pivoting of the blades between predetermined positions, the detent mechanism comprising:

at least one electrically conductive resilient member for engaging the rear portion of one of the blades and releasably retaining the blades in different pivoted positions;

a first seat of the resilient member having an open ended position to allow the rear portion of the blade to be received in the first seat with the blade projecting through the open ended portion of the first seat and extending in a first direction; and a second seat of the resilient member having an open ended portion to allow the rear portion of the blade to be received in the second seat with the blade projecting through the open ended portion of the second seat and extending in a second direction transverse to the first direction to provide the blades with a first predetermined position and a second predetermined position when the one blade is received in the first and second seats, respectively, with the resilient member allowing the blades to be pivoted between the first and second predetermined positions;

wherein the appliance housing includes an opening and the appliance housing mounting members are integral resilient projections on either side of the opening, cooperating mounting bosses and apertures therefor on the housing and the integral projections forming a hinge for pivoting of the housing, and inner facing ramp surfaces on the integral projections to allow the housing to be pushed through the appliance housing opening with the housing sliding along the ramp surfaces of the projections from the interior of the appliance housing towards the exterior thereof with the projections resiliently deflecting until the bosses and apertures are aligned with the bosses moving into the apertures as the projections rebound to provide a press fit for the hinge pivotally mounting the housing to the appliance housing integral projections.

6. The combination of claim 5, wherein the appliance housing includes spring mounting ribs adjacent the integral projections so that the integral projections are between the ribs and the appliance housing opening on each side thereof, and the resilient members are substantially U-shaped spring members each having a base portion and spaced apart side portions with one of the side portions including the blade engaging portions and the other side portion including the contact end portion so that when the spring members are affixed relative to the appliance housing, the one side portions extend into the housing and the other side portions extend between the spring mounting ribs and the integral projections with the spring base portion in the appliance housing interior so as to space the spring members from the hinge between the housing and appliance housing projections.

7. The combination of claim 6, wherein appliance housing spring mounting ribs include restraining surfaces and the other side portions of the spring members include offset tab projections to allow the spring members to be pushed from the interior of the appliance housing to the exterior thereof for causing the seat defining portions to engage with the blades in the housing and the tab projections to with the blades in the housing and the tab projections to resiliently engage the ribs deflecting the other side portions until the tab projection passes the restraining surface with the other side portion rebounding so that the projection is engaged with the restraining surface maintaining the spring members affixed to the appliance housing against being pulled towards the appliance housing interior.

8. An electrical plug assembly having a plug assembly pivotally mounted to an appliance housing having an interior for containing electrical circuitry or devices therein, the electrical plug assembly comprising:

a housing of the plug assembly having an interior and blades rigidly mounted in the housing interior and projecting exteriorly therefrom;

an appliance housing wall having a well for receiving the housing and the blades when pivoted down towards the appliance housing wall and a through opening for receiving a portion of the housing therein;

resilient mounting members projecting from the well towards the appliance housing interior on either side of the through opening and to which the housing is pivotally mounted;

a first snap fit connection between the mounting members and housing to connect the housing to the mounting members by a snap fitting arrangement for pivoting of the housing relative to the appliance housing;

spring members each having a blade engaging portion and a contact end portion with the blade engaging portion disposed in the housing interior for pivoting of the blades engaged therewith between first and second predetermined positions with the spring members releasably retaining the blades in their predetermined positions, and the contact end portion being disposed in the appliance housing interior for being electrically connected with the electrical circuitry or devices therein;

mounting ribs in the appliance housing interior adjacent the mounting members; and a second snap fit connection between the mounting ribs and spring members for connecting the spring members to the ribs to fix the contact ends in the appliance housing interior with the blade engaging portions in the housing interior with the first and second snap fit connections providing ease in assembly of the electrical plug assembly.

9. The electrical plug assembly of claim 8, wherein the housing includes slots with ends of the blades disposed adjacent the slots in the housing interior so that the blade engaging portions of the spring members are received through the slots for engaging the ends of the blades.

* * * * *